US008325006B2

(12) United States Patent
Yoneda

(10) Patent No.: US 8,325,006 B2
(45) Date of Patent: Dec. 4, 2012

(54) CHIP RESISTOR AND METHOD OF MAKING THE SAME

(75) Inventor: Masaki Yoneda, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 169 days.

(21) Appl. No.: 12/639,617

(22) Filed: Dec. 16, 2009

(65) Prior Publication Data

US 2010/0171584 A1 Jul. 8, 2010

(30) Foreign Application Priority Data

Jan. 7, 2009 (JP) ..... 2009-001437

(51) Int. Cl.
*H01C 1/012* (2006.01)

(52) U.S. Cl. ..... 338/309; 338/313; 338/322

(58) Field of Classification Search ..... 338/307–309, 338/332, 313–314, 322, 328
See application file for complete search history.

(56) References Cited

U.S. PATENT DOCUMENTS 6,023,217 A * 2/2000 Yamada et al. ..... 338/309
6,127,722 A * 10/2000 Doi et al. ..... 257/536
6,636,143 B1 * 10/2003 Hashimoto et al. ..... 338/309
6,856,234 B2 2/2005 Kuriyama et al.
7,098,768 B2 * 8/2006 Doi ..... 338/309
2008/0129443 A1 * 6/2008 Tsukada et al. ..... 338/309

FOREIGN PATENT DOCUMENTS

CN 1525497 9/2004
JP 2008-270519 11/2008

* cited by examiner

*Primary Examiner* — Kyung Lee
(74) *Attorney, Agent, or Firm* — Hamre, Schumann, Mueller & Larson, P.C.

(57) ABSTRACT

A chip resistor includes a substrate, a pair of electrode elements, a resistive layer, and a protective layer. The substrate is insulating and includes a first surface, a second surface opposite the first surface and a thickness defined between the first and second surface. The electrode elements are formed on the first and spaced apart. The resistive layer is formed on the first surface and electrically connected to the electrode elements. The protective layer to covers the resistive layer. The first surface faces toward a mounting target, on which the chip resistor is mounted. Each of the electrode elements comprises an electrode layer and a conductive layer formed on the electrode layer. The boundary between the electrode layer and the conductive layer in each of the electrode elements is positioned closer to the substrate than the end surface of the protective layer in the thickness direction of the substrate.

13 Claims, 6 Drawing Sheets

CHIP RESISTOR AND METHOD OF MAKING THE SAME

BACKGROUND OF THE INVENTION

1. Field of the Invention

The present invention relates to a chip resistor and to a manufacturing method of a chip resistor.

2. Description of the Related Art

FIG. 13 illustrates a chip resistor X2 as an example of conventional chip resistor. The chip resistor X2 includes a substrate 91, a pair of electrodes 92, a resistive layer 93, and a protective layer 94.

The substrate 91 is made of an insulating material. The electrodes 92 are provided spaced apart from each other on the substrate 91. Each electrode 92 has a plating layer 921 which is formed along a part of the top surface, the side surface and a part of the bottom surface of the substrate 91 shown in FIG. 13. The purpose of the plating layer 921 is to improve solderability in a mounting state of the chip resistor X2. In other words, the plating layer 921 is a means for ensuring good solderability in the mounting state of the chip resistor X2. The resistive layer 93 is formed on the top surface of the substrate 91 shown in FIG. 13 and electrically connected to the pair of electrodes 92. The protective layer 94 covers the resistive layer 93. On the bottom surface of the substrate 91 shown in FIG. 13, the portions of the pair of electrodes 92 are arranged respectively in the vicinity of ends, in direction x, of the substrate 91 shown in FIG. 13. Thus, the bottom surface of the substrate 91 is exposed at the region between the pair of electrodes 92. As a result, on the bottom surface of the substrate 91 shown in FIG. 13, there forms a distinctive level difference between each of the electrodes 92 and the exposed region of the bottom surface of the substrate 91. This type of chip resistor is disclosed in JP-A-2008-270519, for example.

In a mounting process, the chip resistor X2 having the above configuration is placed on a circuit board, with the bottom surface of the substrate 91 shown in FIG. 13 facing to the circuit board. In the chip resistor X2, the bottom surface of the substrate 91 shown in FIG. 13 is i.e. the mount side surface.

In the chip resistors X2 having the above configuration, there is a pressing demand for smaller sizes and thinner profiles, with a view to increasing the mounting efficiency of the electric circuitry of which the chip resistor X2 is a constituent.

In the chip resistor X2, however, the substrate 91 loses mechanical strength when the thickness thereof is reduced in terms of achieving, for instance, a thinner profile. When the chip resistor X2 with the thickness of the substrate 91 reduced is subjected to load particularly in the mounting process, the substrate 91 may crack at the portion between the electrodes 92 or the substrate 91 may be damaged through bending or the like. This is because the substrate 91 of the chip resistor X2, mounted onto the circuit board as stated above, is supported at its both ends by the two electrodes 92, while there forms a relatively large gap between the circuit board and the exposed region of the bottom surface of the substrate 91 shown in FIG. 13. As noted before, the distinctive level difference between each of the electrodes 92 and the exposed region of the bottom surface of the substrate 91 shown in FIG. 13 is formed in the chip resistor X2.

Any of the above occurrences may give rise to significant errors in the resistance value of the chip resistor X2, or may lead to deviations in the specifications of the electric circuitry of which the chip resistor X2 is a constituent, among other problems.

SUMMARY OF THE INVENTION

The present invention has been proposed under the circumstances described above. It is therefore an object of the present invention to provide a chip resistor provided with a substrate made of an insulating material, wherein problems such as substrate damage or the like can be avoided even when making the chip resistor smaller and thinner. A further object of the present invention is to provide a manufacturing method that is suitable for manufacturing such a chip resistor.

According to the first aspect of the present invention, a chip resistor is provided. The chip resistor of the present invention comprises a substrate, a pair of electrode elements, a resistive layer, and a protective layer. The substrate is made of an insulating material. The substrate includes a first surface, a second surface opposite the first surface and a thickness defined between the first surface and the second surface. The pair of electrode elements is formed on the first surface of the substrate. The electrode elements are spaced apart from each other on the first surface. The resistive layer is formed on the first surface of the substrate and electrically connected to the pair of electrode elements. The protective layer is provided to cover the resistive layer. The first surface of the substrate is a mount side surface to face toward a mounting target, on which the chip resistor is mounted. The pair of electrode elements comprise each an electrode layer and a conductive layer. The electrode layer is electrically connected directly to the resistive layer. The conductive layer is formed on the electrode layer. A boundary between the electrode layer and the conductive layer in each of the electrode elements is positioned closer to the substrate than an end surface of the protective layer in a thickness direction of the substrate.

Preferably, each of the electrode layers comprises a first electrode layer and a second electrode layer. The first electrode layer is provided directly on the first surface of the substrate. The second electrode layer is provided on the first electrode layer. The resistive layer, in this case, is provided so as to overlap a first region of each of the first electrode layers and a region between a pair of the first electrode layers on the first surface. The protective layer, in this case, is provided so as to overlap a second region of each of the first electrode layers while covering the resistive layer. The second region includes the first region. Each of the second electrode layers, in this case, is provided on a third region of a respective one of the first electrode layer. The third region is overlapped by neither the resistive layer nor the protective layer.

Preferably, an end surface of each of the conductive layers in the thickness direction of the substrate is flush with the end surface of the protective layer in the thickness direction of the substrate.

Preferably, at least an outermost surface of the conductive layer consists of a plating film.

Preferably, an additional protective layer is provided on the second surface of the substrate.

According to the second aspect of the present invention, a method of manufacturing a chip resistor is provided. The method of the present invention comprises steps of forming first electrode layers, forming a resistive layer, forming a protective layer and forming second electrode layers. In the first electrode layers forming step, first electrode layers, forming a pair and spaced apart from each other, are formed on a substrate made of an insulating material. The substrate includes a first surface, a second surface opposite the first surface and a thickness defined between the first surface and the second surface. The first electrode layers are formed on the first surface of the substrate. In the resistive layer forming step, a resistive layer is formed so as to overlap a partial region of each of the paired first electrode layers and a region between the paired first electrode layers on the first surface. In the protective layer forming step, a protective layer is formed so as to cover the resistive layer. In the second electrode layers forming step, second electrode layers are formed, each of which is formed on an exposed region of a respective one of the first electrode layers, so that an end surface of each of the second electrode layers in a thickness direction of the substrate is closer to the substrate than an end surface of the protective layer in the thickness direction of the substrate.

Preferably, the step of forming the second electrode layers is carried out by thick film printing.

Preferably, the method further comprises a step of forming conductive layers after the step of forming the second electrode layers. In the conductive layers forming step, each of the conductive layers is formed on a respective one of the second electrode layers so that an end surface of each of the conductive layers in the thickness direction of the substrate is flush with an end surface of the protective layer in the thickness direction of the substrate.

Preferably, the method further comprises a step of forming an additional protective layer on the second surface of the substrate.

The above and further features and advantages of the present invention will become apparent from the following detailed description with reference to accompanying drawings.

DETAILED DESCRIPTION OF THE PREFERRED EMBODIMENTS

Preferred embodiments of the present invention are explained in detail below with reference to accompanying drawings. For an easier explanation, the up/down direction is defined taking FIG. 1 as a reference.

Figure 1:
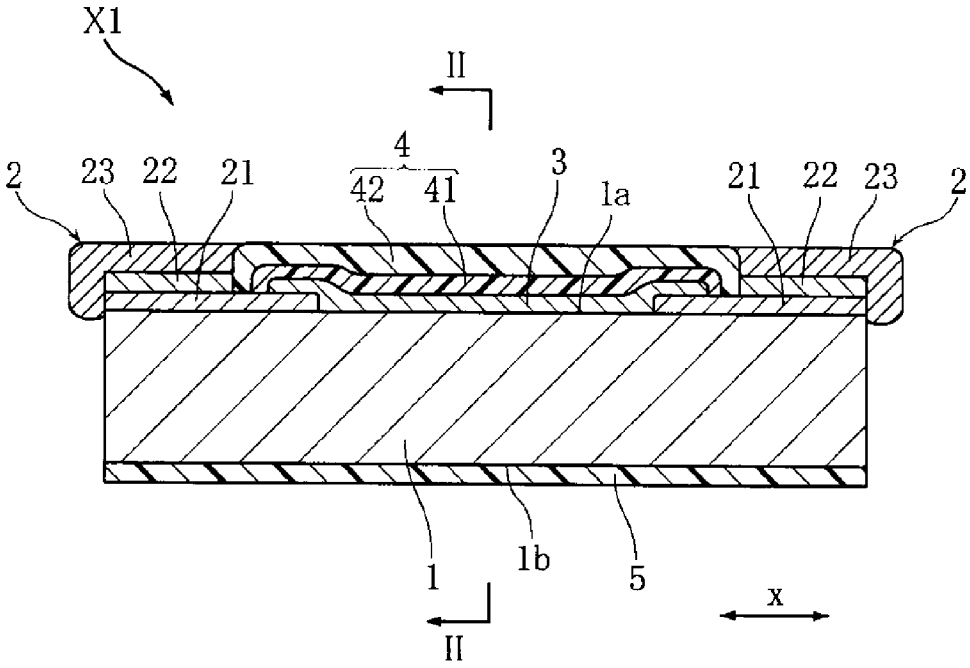
FIG. 1 is a cross-sectional diagram illustrating an example of a chip resistor according to the present invention.
Figure 2:
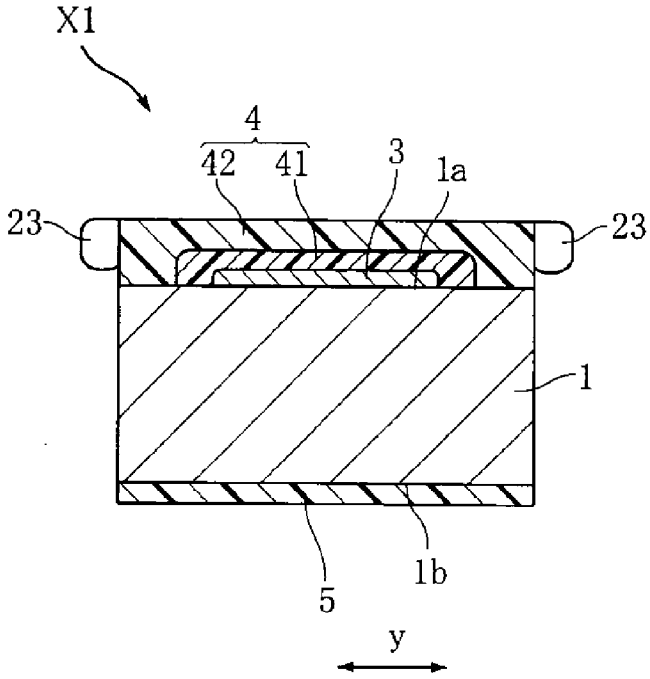
FIG. 2 is a cross-sectional diagram taken along line II-II in FIG. 1.

FIG. 1 and FIG. 2 illustrate a chip resistor X1 according to the present invention. The chip resistor X1, in this embodiment, comprises a substrate 1, a pair of electrode elements 2, a resistive layer 3 and protective layers 4 and 5.

The substrate 1 is made of an insulating material such as $Al_2O_3$ and shaped as a rectangular chip. The substrate 1 has a surface 1*a* and a surface 1*b* opposite the surface 1*a*. The substrate 1 also has a thickness defined between the surfaces 1*a* and 1*b*. The thickness of the substrate 1 is constant at all portions of the substrate 1.

The pair of electrode elements 2 is provided in such a manner that the electrode elements 2 are spaced apart from each other in the longitudinal direction of the substrate 1 (direction x). Each electrode element 2 comprises a first electrode layer 21, a second electrode layer 22 and a conductive layer 23.

Each of the first electrode layers 21 comprises a conductor including e.g. Ag as a main component and is formed directly on the surface 1*a* of the substrate 1. Each of the second electrode layers 22 comprises a conductor including e.g. Ag as a main component and is provided on part of the first electrode layer 21. Specifically, each of the second electrode layers 22 is formed on a respective one of the first electrode layers 21 at a region where the resistive layer 3 described below are not formed as well as the protective layer 4 described below are not formed. The first electrode layer 21 and the second electrode layer 22 make up the electrode layer of the present invention.

Each of the conductive layers 23 is to enhance solderability in the mounting state of the chip resistor X1. At least an outermost surface of the conductive layer 23 consists of a plating film. In this embodiment, the conductive layer 23 is a plating layer resulting from at least one plating treatment with Ni, Sn or the like. Each of the conductive layers 23 is formed so as to cover the top surface of the respective second electrode layer 22, a side surface of the respective first electrode layer 21, and a side surface of the respective second electrode layer 22.

The resistive layer 3 is made of a material having a relatively high resistivity, for instance ruthenium oxide or the like. The resistive layer 3 is provided in such a way so as to overlap a region of the surface 1*a* between the pair of first electrode layers 21, and in such a manner that the resistive layer 3 overlaps a first region of each of the first electrode layers 21. The first region is a region of part, in direction y, of one end portion, in direction x, of each first electrode layer 21. In the present embodiment, the resistance value of the resistive layer 3 is adjusted by laser trimming.

The protective layer 4 is made of a predetermined insulating material. The protective layer 4 covers the resistive layer 3 and overlaps a second region of each of the first electrode layers 21. The second region, in this embodiment, is a region of one end portion, in direction x, of each first electrode layer 21 and includes the above-described first region. Each of the above-described electrode layers 22 is provided on a third region of a respective one of the first electrode layer 21. The third region is overlapped by neither the resistive layer 3 nor the protective layer 4. In the present embodiment, the protective layer 4 is a stack of an undercoat layer 41 and an overcoat layer 42. The undercoat layer 41 is made of e.g. lead glass, while the overcoat layer 42 is made of e.g. an epoxy resin. As illustrated in FIG. 2, the protective layer 4 is formed across the entire width of the substrate 1 in direction y.

The protective layer 5 is made of e.g. an epoxy resin and provided so as to entirely cover the surface 1*b* of the substrate 1.

Examples of the dimensions of the above elements may be, for instance, a dimension of about 0.4 to about 1 mm for the substrate 1 in the longitudinal direction (direction x), and about 0.2 to about 0.5 mm for the substrate 1 in the width direction (direction y). Examples of the thickness of the various elements may be, for instance, a thickness of the substrate 1 of about 0.08 to about 0.3 mm, a thickness of the first electrode layer 21 of about 10 μm, a thickness of the second electrode layer 22 of about 10 μm, a thickness of the conductive layer 23 of about 20 μm, a thickness of the resistive layer 3 of about 10 μm, a thickness of the undercoat layer 41 of about 10 μm, a thickness of the overcoat layer 42 of about 20 μm, and a thickness of the protective layer 5 of about 10 μm.

As can be seen from the above dimensional relationships, the boundary between the second electrode layer 22 and the conductive layer 23 in each of the electrode elements 2 is positioned closer to the substrate 1 or the surface 1*a* than the exposed end surface of the protective layer 4 in the thickness direction of the substrate 1. Also, the exposed end surface of the conductive layer 23 in the thickness direction of the substrate 1 is flush with the exposed end surface of the protective layer 4 in the thickness direction of the substrate 1.

An example of a method of manufacturing the chip resistor X1 is explained next with reference to FIGS. 3 to 11.

Figure 3:
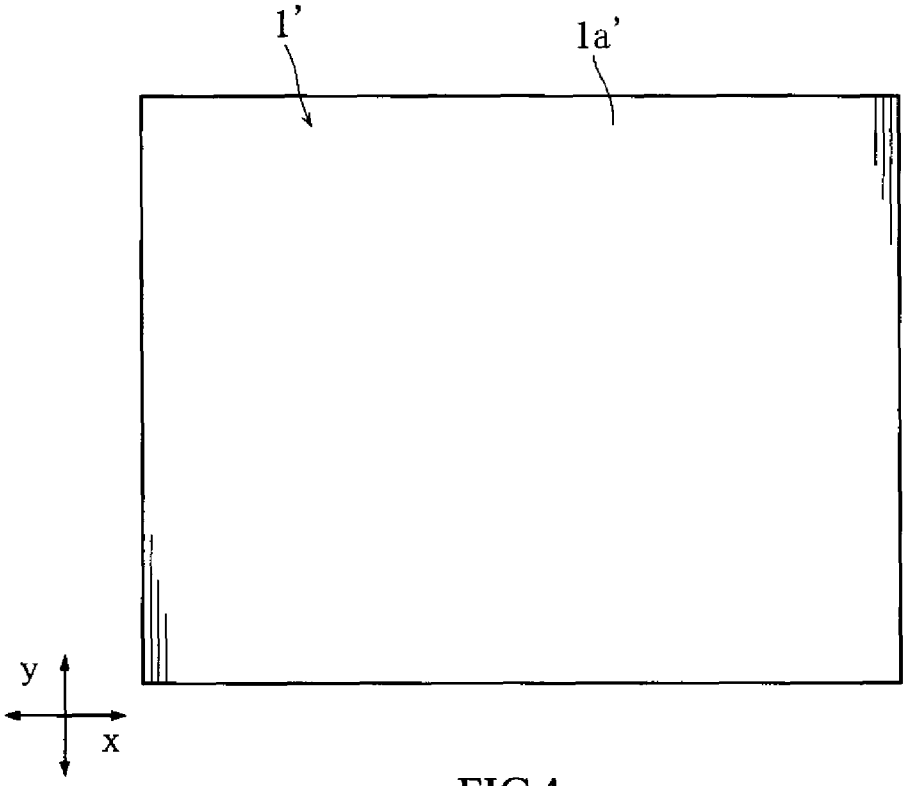
FIG. 3 is a schematic plan-view diagram illustrating part of a process in a method of manufacturing the chip resistor according to the present invention.
Figure 10:
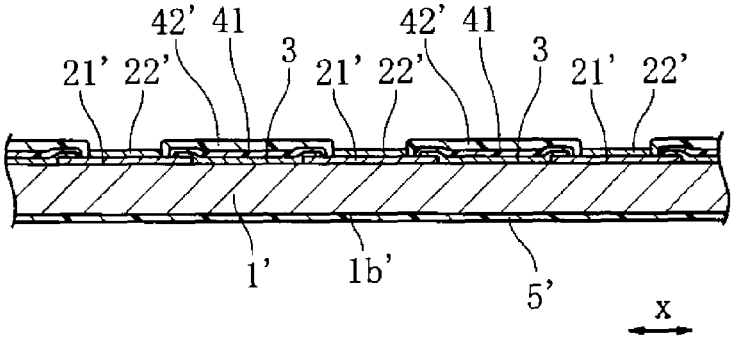
FIG. 10 is a schematic cross-sectional diagram illustrating part of a process in a method of manufacturing the chip resistor according to the present invention.

As illustrated in FIG. 3, a substrate 1' made of an insulating material such as $Al_2O_3$ or the like is prepared first. The substrate 1' includes a surface 1*a'* as shown in e.g. FIG. 3 and a surface 1*b'* opposite the surface 1*a'* as shown in FIG. 10. The substrate 1' is of a size that allows forming a plurality of substrates 1 that make up the chip resistors X1.

Figure 4:
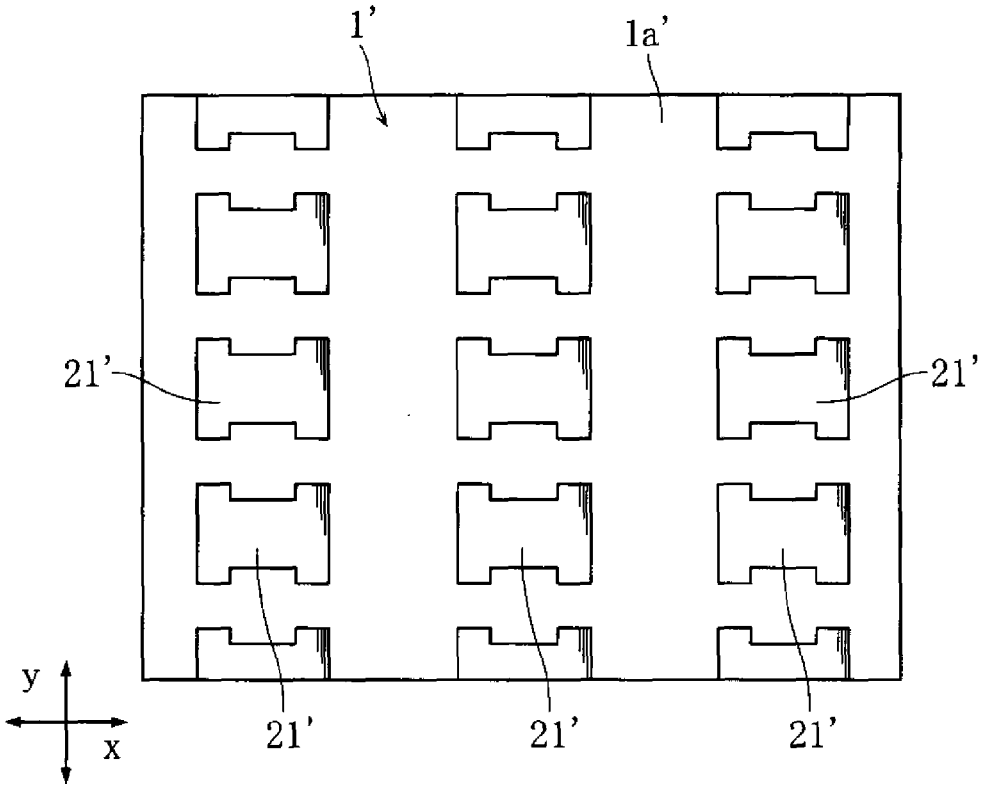
FIG. 4 is a schematic plan-view diagram illustrating part of a process in a method of manufacturing the chip resistor according to the present invention.

Next, as illustrated in FIG. 4, a plurality of first electrode layers 21' is formed on the surface 1*a'* of the substrate 1'. The first electrode layers 21' are spaced apart from each other in both directions x and y. In direction x, the first electrode layers 21' are spaced apart from each other in such a manner that facing end portions of the first electrode layers 21' mutually adjacent in direction x form pairs. The first electrode layers 21' are also arranged in rows in direction y. The first electrode layers 21' are formed by printing a predetermined pattern of a thick film of a conductive paste containing a conductor such as Ag, and firing then the paste.

Figure 5:
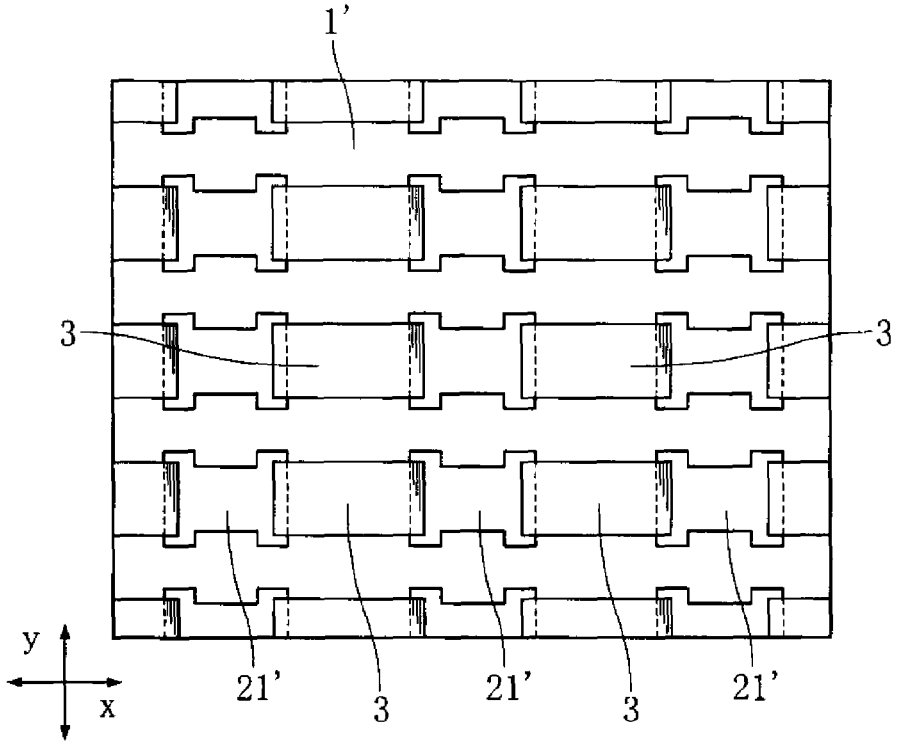
FIG. 5 is a schematic plan-view diagram illustrating part of a process in a method of manufacturing the chip resistor according to the present invention.

Next, as illustrated in FIG. 5, a plurality of resistive layers 3 is formed. To form the resistive layers 3, there is formed or printed a thick film of a resistive paste containing a resistive material such as ruthenium oxide, and then the paste is fired. The resistive paste is printed in the form of a plurality of bands extending in direction x, in such a manner so as to cover the regions of the surface 1*a'* between pair-forming end portions of the adjacent first electrode layers 21'. Each band of the resistive paste overlaps the paired end portions of the adjacent first electrode layers 21'.

Figure 6:
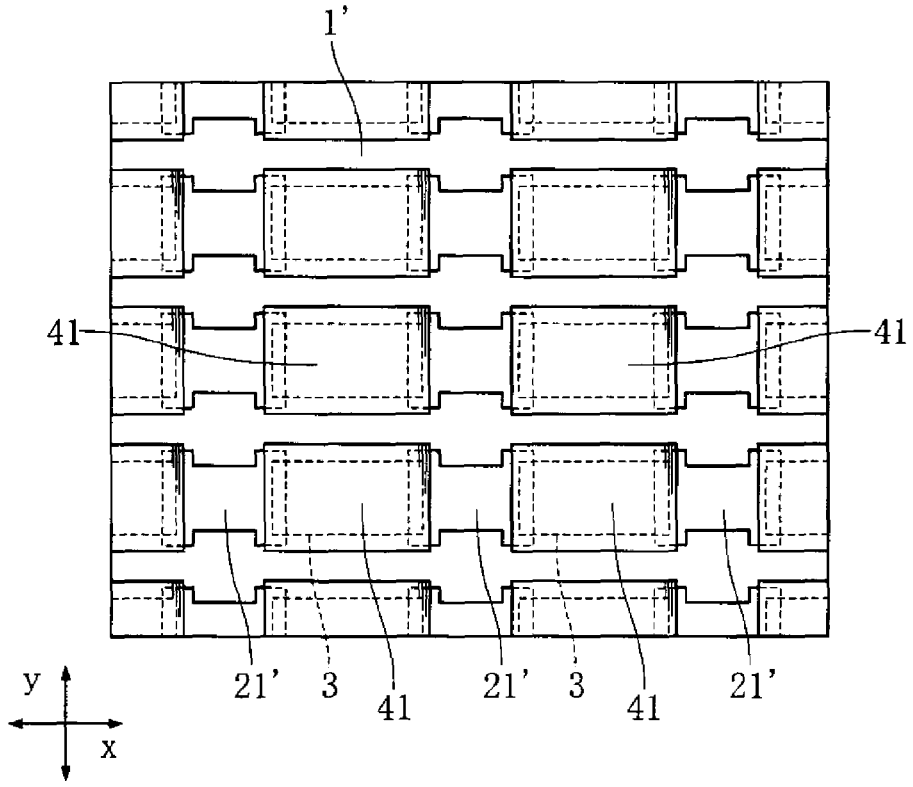
FIG. 6 is a schematic plan-view diagram illustrating part of a process in a method of manufacturing the chip resistor according to the present invention.

Next, as illustrated in FIG. 6, a plurality of undercoat layers 41 is formed. To form the undercoat layers 41, there is formed a thick film of an insulating paste containing an insulating material such as lead glass, and then the paste is fired. The insulating paste is printed in the form of a plurality of bands extending in direction x, in such a manner so as to cover the resistive layer 3 entirely. Each band of the insulating paste overlaps the paired end portions of the adjacent first electrode layers 21'. The resistive layer 3 and the undercoat layer 41 are processed then by laser trimming, to form grooves (not shown).

Figure 7:
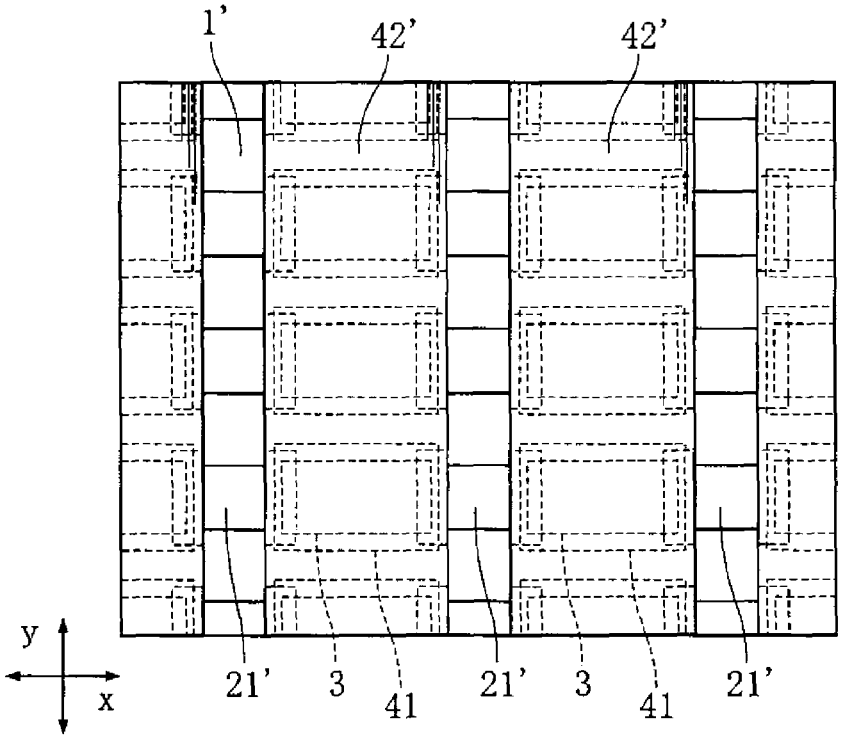
FIG. 7 is a schematic plan-view diagram illustrating part of a process in a method of manufacturing the chip resistor according to the present invention.

Next, as illustrated in FIG. 7, there is formed a plurality of overcoat layers 42'. To form the overcoat layers 42', there is printed a thick film of a thermosetting resin paste such as an epoxy resin, followed by thermal curing. The thermosetting resin paste is printed in the form of a plurality of bands extending in direction y in such a manner so as to overlap the paired end portions of the adjacent first electrode layers 21', and so as to cover each row of undercoat layers 41 entirely.

Figure 8:
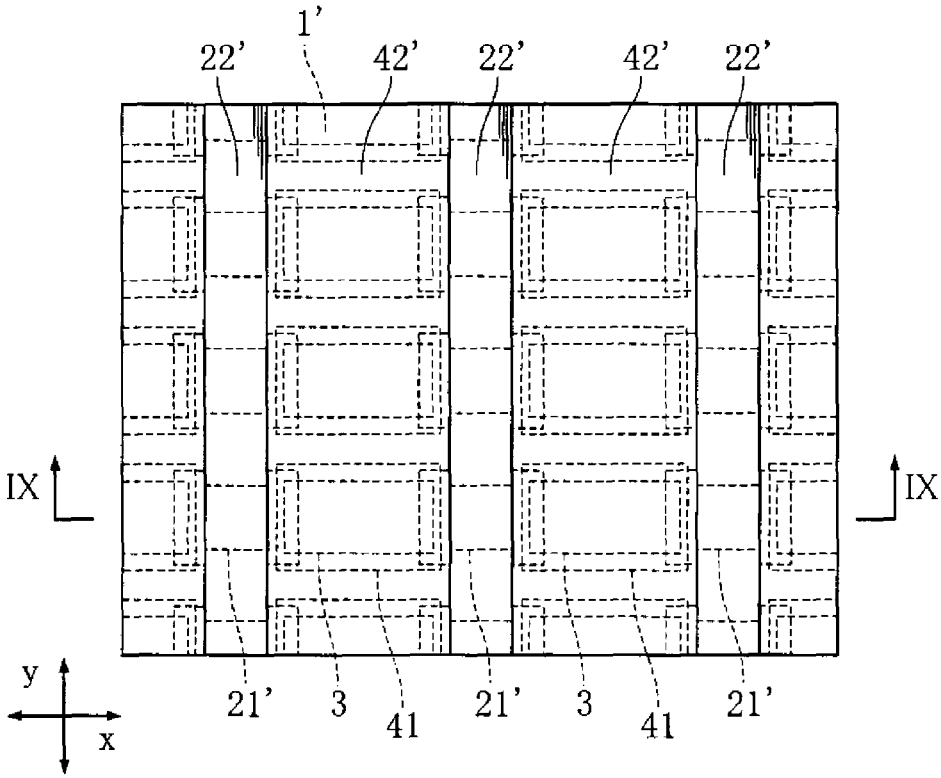
FIG. 8 is a schematic plan-view diagram illustrating part of a process in a method of manufacturing the chip resistor according to the present invention.
Figure 9:
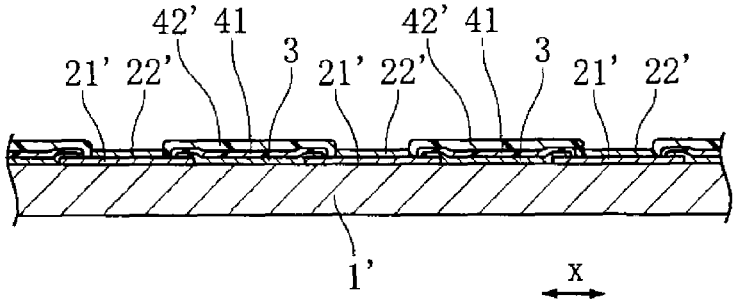
FIG. 9 is a schematic cross-sectional diagram taken along line IX-IX in FIG. 8.

Next, as illustrated in FIGS. 8 and 9, a plurality of second electrode layers 22' is formed. To form the second electrode layers 22', there is printed a thick film of a conductive resin paste, which results from kneading a conductor such as Ag and a thermosetting resin such as an epoxy resin, followed by thermal curing. The conductive resin paste is printed in the form of a plurality of bands extending in direction y in such a way so as to cover the regions where the overcoat layers 42' are not formed, and so as to cover the entire exposed surface of the first electrode layers 21'.

Next, as illustrated in FIG. 10, a protective layer 5' is formed on the surface 1*b'* of the substrate 1'. To form the protective layer 5', there is printed a thermosetting resin paste of epoxy resin or the like, followed by thermal curing. The thermal curing treatments for forming the overcoat layer 42', the second electrode layers 22' and the protective layer 5' can be carried out after sequential printing of the materials of the respective layers, or may all be carried out simultaneously.

Figure 11:
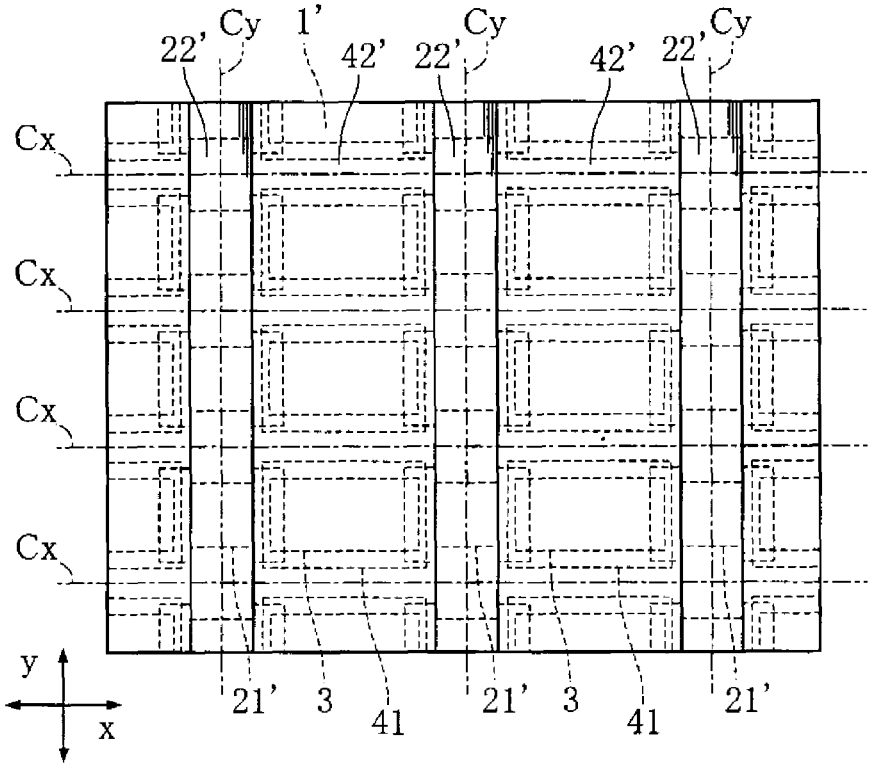
FIG. 11 is a schematic plan-view diagram illustrating part of a process in a method of manufacturing the chip resistor according to the present invention.

Next, as illustrated in FIG. 11, the substrate 1' is cut along cutting lines Cx and Cy. The cutting line Cy coincides substantially with the center of the first electrode layers 21' in direction x. The cutting line Cx coincides substantially with the center of the regions between the resistive layers 3 mutually adjacent in direction y. Cutting may be accomplished by dicing. A plurality of grooves (not shown) may be formed beforehand on the substrate 1' so as to coincide with the cutting lines Cx and Cy, so that the substrate 1' can be bend along the grooves. Through the above cutting, the substrate 1' with elements is divided into a plurality of chips.

The chip is then subjected to an electroless plating treatment with, for instance, Ni and Sn, to form the conductive layer 23. As a result, there is formed the conductive layer 23 in such a way so as to cover the metal exposed surface of the first electrode layer 21 and the second electrode layer 22 (in FIGS. 1 and 2, the end surface of the second electrode layer 22 in the thickness direction of the substrate 1 as well as the side surfaces of the first electrode layer 21 and the second electrode layer 22). The plating conditions are adjusted in such a manner that the exposed end surface of the conductive layer 23 in the thickness direction of the substrate 1 is flush with the exposed end surface of the overcoat layer 42 (protective layer 4) as shown in FIG. 1. The chip resistor X1 illustrated in FIGS. 1 and 2 can be manufactured efficiently through the above-described series of steps.

Figure 12:
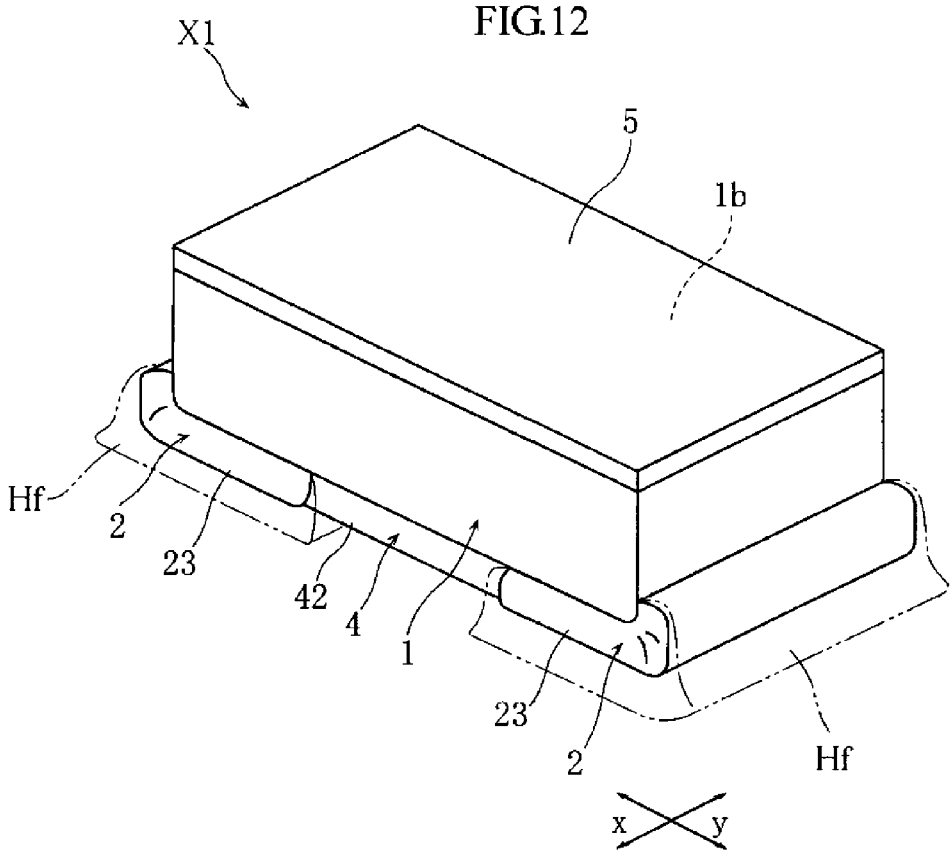
FIG. 12 is a perspective-view diagram illustrating the mounting state of the chip resistor in FIG. 1.

The chip resistor X1 is surface-mounted, for instance by solder reflow, onto a desired mounting target or object such as a circuit board having a mounting surface. In the solder reflow procedure, the chip resistor X1 is flipped so that the surface 1*a* of the substrate 1 becomes the mount side surface which is to face toward the mounting target such as a circuit board. And then, the chip resistor X1 is heated in a reflow oven, with the chip resistor X1 placed so that the electrode elements 2 are positioned on respective terminals provided on the mounting surface of the target. As a result, the chip resistor X1 becomes mounted on the mounting target, with solder fillets Hf being formed at appropriate sites, as illustrated in FIG. 12.

In the mounting process, the chip resistor X1 is placed on the mounting target by means of e.g. a suction holder. When placed on the mounting target, the chip resistor X1 may be subjected to load, for instance, on account of inertia during the placement operation and on account of the air fed for separating the chip resistor X1 from the suction holder.

Figure 13:
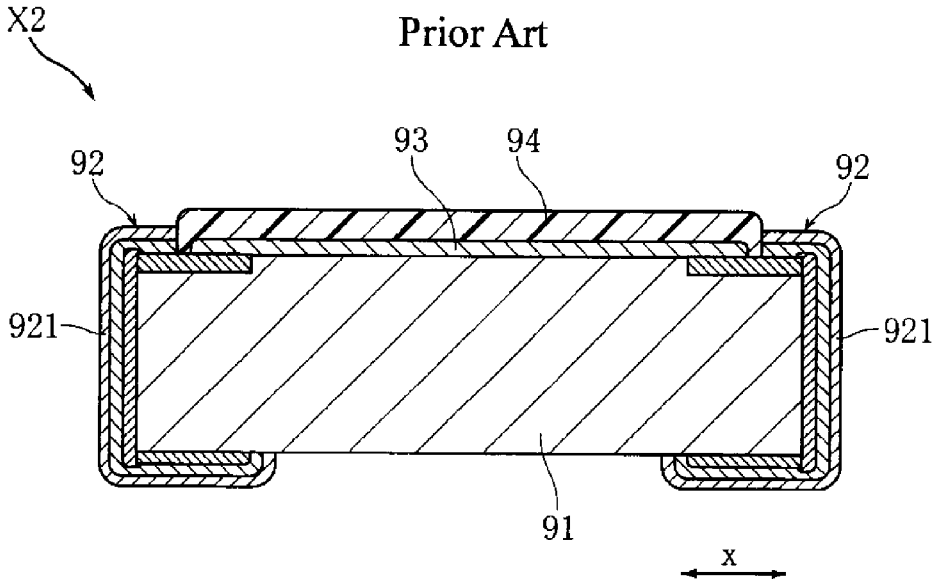
FIG.13 Prior Art
FIG. 13 is a cross-sectional diagram illustrating an example of a conventional chip resistor.

Even in such cases, the chip resistor X1 having the above-described structure is suitable for avoiding problems. Specifically, the chip resistor X1 is suitable for avoiding problems such that the substrate 1 cracks at the portion between the electrode elements 2, or the substrate 1 is damaged through bending or the like, even when making the substrate 1 thinner to achieve a thin-profile chip resistor X1. The reason is as follows: In the chip resistor X1, the boundary between the second electrode layer 22 and the conductive layer 23 in each of the electrode elements 2 is positioned closer to the substrate 1 than the exposed end surface of the overcoat layer 42 (protective layer 4) formed on the surface 1*a* side of the substrate 1. Therefore, the chip resistor X1 can be formed without any level difference, in the thickness direction of the substrate 1, arising between the exposed end surface of the overcoat layer 42 (protective layer 4) and the exposed end surface of each of the conductive layers 23, as can be clearly seen in FIG. 1. The above-described problems in the conventional chip resistor X2 is due to the distinctive level difference between each of the electrodes 92 and the exposed region of the bottom surface of the substrate 91 shown in FIG. 13.

In the present embodiment, the exposed end surface of the conductive layer 23 in the thickness direction of the substrate 1 is formed so as to be flush with the exposed end surface of the overcoat layer 42 (protective layer 4) in the thickness direction of the substrate 1. Therefore, problems such as breakage of the substrate 1 at the portion between the electrode elements 2 can be averted more adequately, even when the chip resistor X1 is subjected to load during mounting.

In the present embodiment, the protective layer 5 is provided so as to entirely cover the surface 1*b* of the substrate 1. Damage to the substrate 1 can thus be prevented more reliably, by dampening shocks to the chip resistor X1 during mounting.

In the present embodiment, the electrode layer has a stacked structure of the first electrode layer 21 and the second electrode layer 22. This allows adjusting, as desired, the positional relationship of the end surface of the electrode layer (second electrode layer 22) relative to the exposed end surface of the protective layer 4 in the thickness direction of the substrate 1, in a stack of the resistive layer 3, the electrode layer (first and second electrode layers 21, 22) and the protective layer 4. The fact that the adjustment of the above-described positional relationship is allowed leads to a reduction in the thickness of each the conductive layer 23, even when the exposed end surface of each of the conductive layers 23 in the thickness direction of the substrate 1 is flush with the exposed end surface of the overcoat layer 42 (protective layer 4) in the thickness direction of the substrate 1, as described above. The thin conductive layers 23 contribute to shortening the formation time of the conductive layers 23 formed by electroless plating treatment, which is time costing in general. The thin conductive layers 23 further contribute to reducing the size of the chip resistor X1.

In the above-described manufacturing method, the step of forming the second electrode layers 22' (second electrode layers 22 for the chip resistor X1) in FIGS. 8 and 9 is carried out by thick film printing. Such a manufacturing method allows forming the second electrode layers 22' easily. Also, the thickness of the second electrode layers 22' can be finished accurately to desired dimensions. The above is suitable for adjusting, as desired, the positional relationship of the end surface of the second electrode layer 22' (second electrode layer 22 for the chip resistor X1) relative to the exposed end surface of the overcoat layers 42' (overcoat layer 42 for the chip resistor X1) in the thickness direction of the substrate 1.

In the present embodiment, each of the conductive layers 23 is the uppermost layer in the electrode element 2 in the thickness direction of the substrate 1. In other words, the surface-exposed portion of the pair of electrode elements 2 is made up of the conductive layers 23. The conductive layer 23 affords greater solder joint strength than that of the material of the underlying electrode layer (first and second electrode layers 21, 22). This arrangement, therefore, is suitable for increasing the solder joint strength of the mounted chip resistor X1.

In the present embodiment, the conductive layer 23 is formed also on the side surfaces of the first electrode layer 21 and the second electrode layer 22. As a result, a solder fillet Hf of appropriate size forms at the side surfaces, as illustrated in FIG. 12, in the mounting process. Such a mounting structure having the solder fillet Hf is suitable for increasing the solder joint strength and the conduction reliability between the chip resistor X1 and the target on which the chip resistor X1 is mounted.

The chip resistor X1 and the manufacturing method thereof according to the present invention are not limited to the above-described embodiments. The specific features of the chip resistor X1 and the manufacturing method thereof according to the present invention can accommodate various design modifications.

The invention claimed is:

1. A chip resistor, comprising:

a substrate made of an insulating material, the substrate including a first surface, a second surface opposite the first surface and a thickness defined between the first surface and the second surface;

a pair of electrode elements formed on the first surface of the substrate and spaced apart from each other on the first surface;

a resistive layer formed on the first surface of the substrate and electrically connected to the pair of electrode elements; and a protective layer provided to cover the resistive layer; wherein:

the first surface of the substrate is a mount side surface to face toward a mounting target;

the pair of electrode elements comprise each an electrode layer and a conductive layer, the electrode layer being electrically connected directly to the resistive layer, the conductive layer being formed on the electrode layer;

the electrode layer of each electrode element includes a first electrode layer and a second electrode layer, the first electrode layer being provided directly on the first surface of the substrate, the second electrode layer being provided directly on the first electrode layer;

a boundary is defined between the second electrode layer and the conductive layer in each of the electrode elements, and the boundary as a whole is positioned closer to the substrate than an end surface of the protective layer in a thickness direction of the substrate;

the substrate includes a pair of side surfaces opposite to each other and spaced apart from each other in a direction in which the electrode elements are spaced, and each of the side surfaces is exposed at least partially from a respective one of the conductive layers; and in each electrode element, the first electrode layer and the second electrode layer include ends, respectively, that are flush with a corresponding one of the pair of the side surfaces.

2. The chip resistor according to claim 1, wherein the resistive layer is provided so as to overlap a first region of each of the first electrode layers and a region between a pair of the first electrode layers on the first surface;

the protective layer is provided so as to overlap a second region of each of the first electrode layers while covering the resistive layer, the second region including the first region; and each of the second electrode layers is provided on a third region of a respective one of the first electrode layer, the third region being overlapped by neither the resistive layer nor the protective layer.

3. The chip resistor according to claim 1, wherein an end surface of each of the conductive layers in the thickness direction of the substrate is flush with the end surface of the protective layer in the thickness direction of the substrate.

4. The chip resistor according to claim 1, wherein at least an outermost surface of the conductive layer consists of a plating film.

5. The chip resistor according to claim 1, wherein an additional protective layer is provided on the second surface of the substrate.

6. A method of manufacturing a chip resistor, comprising the steps of:

forming first electrode layers, forming a pair and spaced apart from each other, on a substrate made of an insulating material, the substrate including a first surface, a second surface opposite the first surface and a thickness defined between the first surface and the second surface, the first electrode layers being formed on the first surface of the substrate;

forming a resistive layer so as to overlap a partial region of each of the paired first electrode layers and a region between the paired first electrode layers on the first surface;

forming a protective layer so as to cover the resistive layer;

forming second electrode layers, each of the second electrode layers being formed on an exposed region of a respective one of the first electrode layers;

cutting the substrate after the second electrode layers are formed; and forming conductive layers on the second electrode layers, respectively, by plating, wherein the second electrode layers are formed in a manner such that each of the second electrode layers includes an end surface in a thickness direction of the substrate, the end surface as a whole being closer to the substrate than an end surface of the protective layer in the thickness direction of the substrate, wherein the substrate is cut together with said each of the second electrode layers and the respective one of the first electrode layers in a manner such that the substrate provides a pair of side surfaces opposite to each other and spaced apart from each other in a direction in which the pair of first electrode layers are spaced, and such that said each of the second electrode layers and the respective one of the first electrode layers including cut ends, respectively, that are flush with one of the pair of the side surfaces, and wherein each of the conductive layers is formed in a manner such that a respective one of the side surfaces is exposed at least partially from the conductive layer.

7. The method of manufacturing a chip resistor according to claim 6, wherein the step of forming the second electrode layers is carried out by thick film printing.

8. The method of manufacturing a chip resistor according to claim 6, wherein the conductive layers are formed in a manner such that an end surface of each of the conductive layers in the thickness direction of the substrate is flush with an end surface of the protective layer in the thickness direction of the substrate.

9. The method of manufacturing a chip resistor according to claim 6, further comprising a step of forming an additional protective layer on the second surface of the substrate.

10. The chip resistor according to claim 1, wherein the first surface includes a first edge and a second edge each extending in the direction in which the electrode elements are spaced, the first edge is spaced apart from the second edge in a direction perpendicular to both the thickness direction of the substrate and the direction in which the electrode elements are spaced, and the second electrode layer extends from the first edge to the second edge.

11. The method of manufacturing a chip resistor according to claim 6, wherein in the step of cutting the substrate, the second electrode layers are cut along a cutting line extending in the direction in which the pair of first electrode layers are spaced.

12. The chip resistor according to claim 1, wherein the first electrode layer of each electrode element is held in direct contact with the resistive layer.

13. The chip resistor according to claim 1, wherein in each electrode element, the end of the first electrode layer is disposed between the end of the second electrode layer and the corresponding one of the pair of the side surfaces in the thickness direction of the substrate.

* * * * *